US006202577B1

(12) United States Patent
Boguslavsky et al.

(10) Patent No.: US 6,202,577 B1
(45) Date of Patent: Mar. 20, 2001

(54) METHOD AND APPARATUS FOR TREATING REFUSE

(76) Inventors: Anatoly Boguslavsky, 1111 Parsippany Bvd. #217, Parsippany, NJ (US); Yuriy Rabiner, 2 S. Pinehurst Ave. #3B, New York, NY (US) 10033

( * ) Notice: Subject to any disclaimer, the term of this patent is extended or adjusted under 35 U.S.C. 154(b) by 0 days.

(21) Appl. No.: 09/458,266

(22) Filed: Dec. 9, 1999

(51) Int. Cl.[7] ..... F23G 5/02; F23D 14/00; F23J 15/00; F27B 7/36

(52) U.S. Cl. ..... 110/346; 110/219; 110/235; 110/220; 110/226; 110/227; 110/228; 110/229; 110/342; 110/246; 110/204; 110/215

(58) Field of Search ..... 110/219, 235, 110/220, 226, 227, 228, 229, 342, 346, 246, 204, 210, 215, 216, 225; 432/105, 108

(56) References Cited

U.S. PATENT DOCUMENTS 4,247,367 * 1/1981 Reilly ..... 202/105
4,285,773 * 8/1981 Taciuk ..... 202/100
4,292,742 * 10/1981 Ekberg ..... 34/35
4,485,745 * 12/1984 Bracker et al. ..... 110/229
4,602,573 * 7/1986 Tanca ..... 110/342
4,768,448 * 9/1988 Nolbilet et al. ..... 110/346
4,788,918 * 12/1988 Keller ..... 110/215
4,797,091 * 1/1989 Neuman ..... 432/14
4,878,440 * 11/1989 Tratz et al. ..... 110/233
4,934,931 * 6/1990 Angelo ..... 432/105
4,958,578 * 9/1990 Houser ..... 110/246
5,372,077 * 12/1994 Yen et al. ..... 110/233
5,517,930 * 5/1996 Farwick et al. ..... 110/345
5,669,317 * 9/1997 May et al. ..... 110/229
5,680,821 * 10/1997 Wright et al. ..... 110/257
5,826,518 * 10/1998 Bhat et al. ..... 110/216
5,862,762 * 1/1999 Sekiguchi et al. ..... 110/346

* cited by examiner

*Primary Examiner*—Denise L. Ferensic
*Assistant Examiner*—Ken Rinehart
(74) *Attorney, Agent, or Firm*—Herbert Dubno

(57) ABSTRACT

A municipal or like refuse, from which large articles of metals have been removed, is mixed with an alkaline substance like limestone preferably in a triple screw mixer, and then advanced along the pyrolysis path in which the refuse mixture is subjected to heat from combustion gases from an incineration chamber therebelow. A portion of the pyrolyzed product is recycled to the upstream side of that path and the remainder of the pyrolyzed product is scrubbed with an aqueous medium, e.g. water and/or aqueous acetic acid and the washed pyrolyzed product is then incinerated to produce the combustion gas.

13 Claims, 11 Drawing Sheets

METHOD AND APPARATUS FOR TREATING REFUSE

FIELD OF THE INVENTION

Our present invention relates to a method of and to an apparatus for the treatment of solid wastes and particularly refuse independently or together with sewage sludge or biamass.

BACKGROUND OF THE INVENTION

Solid domestic waste collected in the United States at the present time, amounts to more than 200,000,000 tons annually and of this amount of solid waste only 27% is amenable to recycling. The remainder must be disposed of in some fashion and for that purpose disposal in landfills, incineration and the like are among the most common methods. Landfills contaminate the environment, are unsightly and must cover large areas when such large volumes of waste are considered. They have been located near residential areas in the past because of the expense of transportation and increasingly there is pressure to avoid siting landfills near large residential areas and hence a search with increased importance for other ways of dealing with such solid wastes.

Pyrolytic decomposition is one method of disposing of solid waste which has the advantage over the use of landfills, in that valuable product may be obtained from the pyrolysis or incineration process.

This method need not involve preliminary sorting and in the past was carried out at about 3000° F. to produce steam and a synthesis gas in the form of a mixture of carbon monoxide and hydrogen (see U.S. Pat. No. 2,134,944 and Martin, K. and Bastock, T. W., "Waste Minimization: A Chemist's Approach" Royal Society of Chemistry, 1994, page 111). However, in such systems the products obtained require complex purification. The process requires the use of expensive construction material because of the high temperatures used, involve a high consumption of fuel, are complex and are complicated by the presence of chlorine-containing substances in the refuse.

A pyrolysis at about 1500° F. is known. This temperature is required for complete destruction of low temperature resins (Kaiser, E. R. and Friedman, S. B. "The Pyrolysis of Refuse Components, Incinerator and Solid Waste Technology" the American Society of Mechanical Engineers, 1975, pages 247–256). A similar method has been proposed to obtain a liquid fuel from refuse (see "The Star Ledger", Jan. 29, 1998). Problems were involved with this approach as well because of the presence of chlorine and organic compounds thereof, especially polyvinylchloride. In general the presence of chlorine as an aggressive and corrosive substance in solid wastes has proved to be problematical.

In the past it has been found that incinerators operate with a heat recovery coefficient of 65% or less (Brown, A., Evermy P. and Ferrero, G. L. "Energy Recovery through Waste Combustion", Elsevier Applied Science, Inc., 1988, page 252). In such systems it proved to be impossible to neutralize discharged hydrogen chloride during the combustion because of a difficulty in mixing neutralizing agents into the system. When neutralization can be carried out, a product, for example, a chloride salt in the form of molten calcium chloride can be produced which can block the interstices and prevent penetration of air into the system and hence efficient combustion (Brunner, Calvin R. "Handbook of Incineration Systems", McGraw Hill Inc., 1988, page 12.6). Large amounts of fuel are required, for example 256.9 liters per ton of refuse at furnace temperatures of about 2200° F. (page 24.6).

The literature apparently recognizes that the use of solid neutralizing agents is possible only in a fluidized bed combuster. It has been found that fluidized bed systems require substantial amounts of energy to provide the suspending blast of fuel, amounting say to 20.5 to 23.5 cubic meters of fuel or suspending gas per ton of refuse processed (see DeKadt, M. and Saphire, D., "Burning Garbage in the U.S. Practice vs. State of the Art" Inform Inc., 1991 pages 58 and 132).

In addition, incineration in fluidized bed combusters requires the use of refuse particles of a uniform size (usually 1" to 1.5"), the absence of glass and easily melted metals, such as aluminum and like restrictions: (Brunner, Clavin R. "Handbook of Incineration Systems", McGraw Hill Inc., 1988, pages 13.16–13.18).

U.S. Pat. Nos. 4,800,824 and 5,445,087 describe two such processing of refuse with preliminary pyrolysis followed by combustion of pyrolysis-generated gases. These processes can give rise to caking of refuse on the walls or surfaces of the pyrolysis chamber, restrictions in the handling of polyvinylchloride because of the formation of aggressive and corrosive HCL and portions of the environment with salts of heavy metal in addition to other drawbacks.

A continuous incineration method as described in U.S. Pat. No. 5,289,787 permits reburning of pyrolytic residues but has the disadvantages already mentioned.

U.S. Pat. Nos. 4,353,713, 4,448,558 and 4,597,771 disclose the processing of coal together with a light fraction of municipal solid waste in which there is a preliminary sorting and crushing of such waste, a mixture of the waste with limestone, a pyrolysis of the resulting mixture with purification of the pyrolysis gases and extrusion of certain products, a combustion of the residue and use of liberated heat and the heat of an exothermic reaction between the limestone or dolomite and carbon dioxide. These processes, however, can lead to pollution of the environment with toxic salts of heavy metals and are unable to process solid plastic wastes in spite of the fact that limestone and dolomite may be present to neutralize HCL released by decomposition of the plastics. These drawbacks of the earlier systems can be explained by the fact that calcium chloride which tends to be formed is in a molten state under the high conditions of these processes and causes waste to stick together and lump up and reduces the permeability of the waste to gas flow. The molten $CaCl_2$ also interferes with the ability of components of the pyrolyzable mass to intermix. The melting point of calcium chloride is 1358 to 1376° F., well below 2000 to 2400° F. of the system and within the range of 1200 to 2400° F. of the system and within the range of 1200 to 1800° F. maintained in the gasification vessel. The molten calcium chloride, therefore, makes the processing of polyvinylchloride and other chlorine-containing polymers practically impossible.

High temperatures in combustion chambers of say 1500 to 1800° F. means that salts of heavy metal (usually chlorides or sulfates) are present in a molten state since the melting point of these salts generally lies between 467° F. and 1678° F. Vapor of these salts are also present and are in equilibrium with the molten salts. Because the partial pressures of these vapors are low, by and large they are entrained in the flue gas away from the combustion chamber and can enter the ambient atmosphere. The low concentrations prevent them from being separated out although they are of levels which can pose substantial problems.

Finally it should be noted that in practically all of these processes, there is the danger of formation of secondary contaminants such as chlorobenzenes, chlorophenols, PCBs, dioxins and the like. Heavy metal salts are detectable in the incinerator atmosphere as well as in the ash and slags (see "Earth in the Balance, Ecology and the Human Spirit", Houghton Mifflin Co. 1993, page 156).

Mention can also be made of the plasma techniques for disposing of solid wastes and which produce fuel gases and do not form the secondary contaminants mentioned above. However, these processes cannot eliminate heavy metals and their salts and the product flue gases which the processes produce have substantially lower heat content than gases produced by other techniques.

OBJECTS OF THE INVENTION

It is, therefore, the principal object of the present invention to provide an improved method of disposing of solid refuse, also known as household waste or refuse or municipal waste or refuse, in conjunction with or independently of the disposal of sewage slag, whereby drawbacks of the earlier systems are avoided.

Another object of this invention is to provide a waste disposal system that is more economical than earlier systems, produces fuel gases of high heat value, poses less of an environmental danger than earlier systems and solves the problems of environmental contamination both with respect to release of toxic gases into the environment and with respect to the release of heavy metal salts into the environment.

Another object of the invention is to provide an improved apparatus for practicing the method of the invention.

SUMMARY OF THE INVENTION

These objects can be obtained, in accordance with the invention, in a method of treating refuse which comprises the steps of:

(a) removing large metallic articles from refuse to form a pyrolyzable refuse product;

(b) mixing the pyrolyzable refuse product with limestone in an amount sufficient to combine with chlorine contained in the pyrolyzable refuse product and optionally with a sewage sludge to form a pyrolyzable mixture;

(c) passing the pyrolyzable mixture along a rotary drum of a rotary kiln in one direction while subjecting the pyrolyzable mixture to pyrolysis by heating with a combustion gas to produce pyrolysis gases discharged from the rotary kiln and a pyrolyzed product;

(d) recycling a portion of the pyrolyzed product in a hot state through a recycling tube extending axially through the drum to mix with the pyrolyzable refuse product at an upstream side of the rotary drum whereby the pyrolyzable refuse product is dehydrochlorinated and discharged hydrogen chloride is neutralized by the limestone at a temperature produced at least in part by mixing the recycled portion with the pyrolyzable refuse product;

(e) washing another portion of the pyrolyzed product with an aqueous washing liquid to remove inorganic salts from this portion of the pyrolyzed product and produce a washed pyrolyzed product, drying it by mixing with part of hot slag; and (f) incinerating the washed pyrolyzed product to produce a slag residue and the combustion gas.

The apparatus can comprise:

a rotary kiln having a rotary drum surrounding a recycling tube and fed with a pyrolyzable mixture of a pyrolyzable refuse product from which large metallic articles have been removed, limestone in an amount sufficient to combine with chlorine contained in pyrolyzable waste product and optionally a sewage sludge, the pyrolyzable mixture passing along the rotary drum of the rotary kiln in one direction while being subjected to pyrolysis by heating with a combustion gas to produce pyrolysis gases, which is directed to posterior treatment. A portion of a pyrolyzed product produced in the rotary kiln being recycled through the tube in a hot state to mix with the pyrolyzable refuse product at an upstream side of the rotary drum whereby the pyrolyzable refuse product is dehydrochlorinated and discharged hydrogen chloride is neutralized by the limestone at a temperature produced at least in part by mixing the recycled portion with the pyrolyzable refuse product;

a fire chamber enclosing the drum and provided with a traveling grate below the drum for incinerating washed pyrolyzed product; and a washer between the drum and the traveling grate for washing another portion of the pyrolyzed product with an aqueous washing liquid to remove inorganic salts from the other portion of the pyrolyzed product and produce the washed pyrolyzed product, mixer of above-mentioned product with part of hot slag for obtaining dry product.

A key to the invention is a low temperature thermal decomposition contained in refuse chlororganics by recycling of portions of pyrolyzed hot product with simultaneous neutralization of discharged hydrogen chloride by limestone; and washing of another portion of pyrolyzed product by aqueous washing liquid to remove inorganic salts from it; and extraction and collection of salts of heavy metals from both pyrolysis gas and solid products of pyrolysis.

The combination of an incinerating chamber containing the traveling grate, and the kiln in which pyrolysis is effected and which uses a recycling at least in part of the pyrolyzable refuse produce in the kiln and washer to remove inorganic salts from the aforementioned part of the pyrolyzed product has been found to greatly increase the efficiency of the overall disposal process.

According to the invention, therefore, the municipal trash can be shredded and from which large metallic articles and particles can be removed by any conventional process, e.g. manually, by magnetic or other safety means, or by any other conventional process used in the handling of municipal wastes and the resulting pyrolyzable product is mixed with limestone or some other alkali or alkaline agent capable of trapping hydrogen chloride. The preferred component is crushed limestone or dolomite. The mixture is subjected to pyrolysis and with gases released by the pyrolysis are subjected in turn to condensation and fractionation to recover useful products. The solid residue of the pyrolysis is then burned in the incineration stage together with liquid products taken wholly or partly of the pyrolysis and any noncondensible part of the pyrolyzed gases which may remain from the condensation step so that such liquid products and noncondensible gases contribute to generating the heat in the combustion gas of the incinerator stage which is used for the aforementioned pyrolysis.

The incineration stage then produces a slag which, in turn is used to heat the blast or for the traveling grate incinerator and for combustion of the liquid products and noncondensible part of the pyrolysis gases, for producing steam and for the extraction of inorganic salts from any aqueous scrubbing solutions which are produced in the process.

The rotary drum kiln which is used contains, as has been described, for example, in U.S. Pat. No. 3,588,061, a loading device, a triple screw mixer, a rotary drum having internal and external helical ribs and a tube through which a portion of the pyrolyzed product is recycled to an upstream end of the rotary drum, and a discharge device for the pyrolyzed product.

The apparatus of the invention includes not only that rotary kiln but the aforementioned combustion chamber, a traveling grate at a lower portion thereof, the slag cooler receiving the residue from the traveling grate, means, if desired, for recycling of unburned and only partially burned particles passing through the grate bars to the combustion chamber, drying mixer of hot slag and wet washed pyrolyzed product, a separator for the preliminary purification of the pyrolysis gas, a condenser for condensing liquids from the pyrolysis gas and rectifying columns for the fractionation of the condensate.

In addition, a waste heat boiler, an inorganic salt extractor unit for separating them, and a stack can be provided for discharge of the nonpolluting gases which remain after the gas cleaning operation. All of these units are interconnected by a system of pipe lines and pumps as may be required.

The pyrolysis carried out at a low temperature which prevents formation of PCBs and other chlorine-containing aromatics, dioxins and furanes and environmental pollution with salts of heavy metals is likewise prevented. The process reduces fuel consumption per unit volume or weight of the refuse treated and avoids emission of nitrogen oxides and like environmental pollutants into the atmosphere.

The process can produce salts of heavy metals and water soluble inorganic salts and a slag capable of industrial use.

By recycling solid products in the pyrolysis stage, we are able to ensure a low temperature dehydrochlorination of chlorine-containing organic residues with simultaneous neutralization of discharged HCL at temperatures of 390 to 570°. The recycle in the pyrolysis stage prevents the municipal wastes and any sewage sludge which may be added thereto from limiting or sticking to the heated surfaces of the drum during the pyrolysis. The pyrolysis can bring the mixture to a temperature of 840 to 930° F. which is well below the temperature at which the high temperature reactions for producing organic chlorine contaminants can take place.

The solid pyrolysis residue is washed at a temperature of 200 to 220° F. with hot water or aqueous acid, for example acetic acid obtained in the pyrolysis process and extracted by fractionation of 200 to 210° F.

Vapors which are produced during washing are recycled to the fractionation stage and the solid washed residue of pyrolysis is burned in the incineration stage along with liquids which cannot be utilized otherwise and the noncondensed pyrolyzed gases mentioned previously.

The washing extracts salts of heavy metals from the solid pyrolysis products and thus prevents contamination of the environment with these heavy metals and makes the heavy metal salts available as useful products. The washing also removes chlorides, mostly calcium chloride and sodium chloride from the solid residues of pyrolysis to limit corrosion in the fire chamber. The washing also raises the specific heating value of the solid pyrolysis product.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
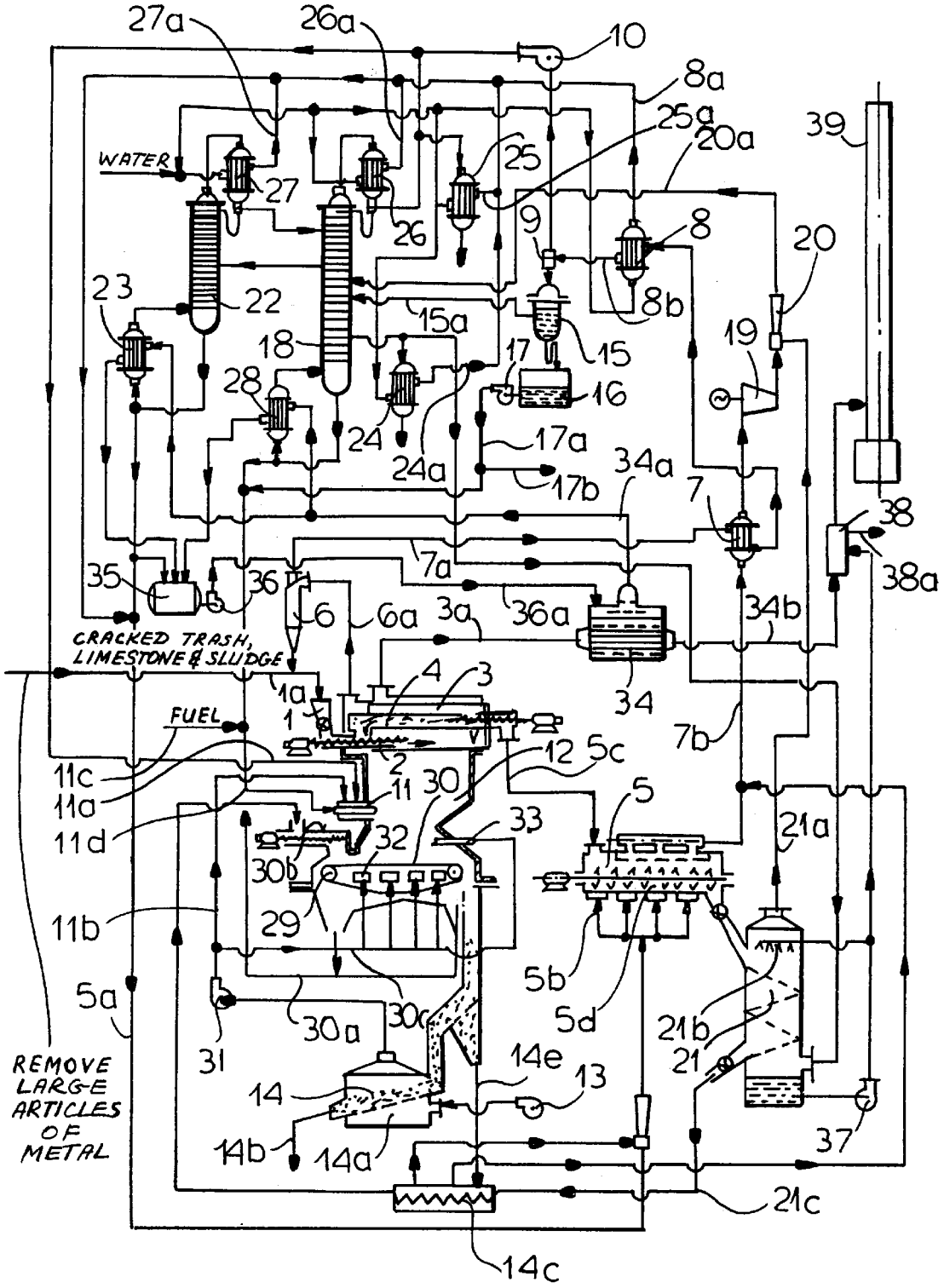
FIG. 1 is a flow diagram of one embodiment of the process of the invention.
Figure 1A:
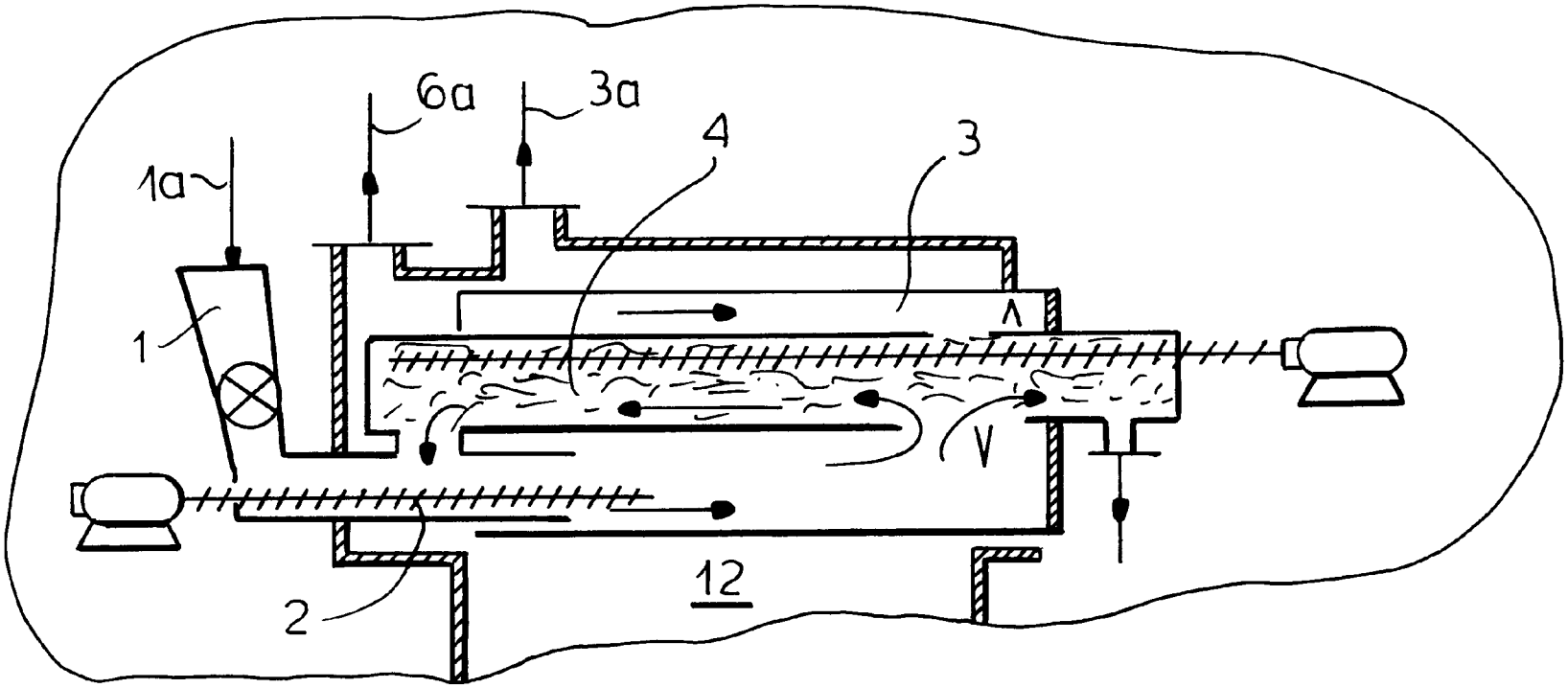

Comminuted trash, mixed with limestone and with sewage sludge which may have been dried in another process and ground are fed to the rotary drum kiln 3 from a charging bin with a sectional feeder and triple screw mixer 2. The rotary drum kiln 3 is of the type described in the aforementioned patent. Additional biomass may be added as may be required to the mixture introduced into the bin 1. The limestone is mixed with the refuse in a ratio by weight of 1:5 to 1:20 depending upon the chlorine content of the refuse and should be sufficient at least to bond stoichiometrically all of the chlorine.

From the discharge end of the drum through a recycling tube 4 by a special device, a solid pyrolyzed product is partly recycled to the upstream end of the drum and to a mixer 2 where it is mixed into the refuse/limestone/sludge mixture. The recycling tube 4 extends axially and centrally through the rotary drum of the kiln 3. Recycling of the hot pyrolyzed product prevents the pyrolyzable substances from lumping and sticking to the walls of the drum and supplies reaction of the decomposition of chlororganic substances necessary heat. In the mixer 2 a temperature of preferably 460 to 500° F. is maintained to effect dechlorination. The product emerging after dechlorination and neutralization into the drum at the outlet of the mixer usually has a temperature of 390 to 400° F. The recycle has a temperature of about 660° F. The HCL removed from the refuse is picked up by the limestone in a neutralizing process.

Within the drum, pyrolysis is effected at a temperature in the range of 840 to 930° F. resulting from the heat supplied to the drum by combustion bases rising in the combustion chamber 12 at the top of which the rotary drum kiln 3 is provided. This temperature is sufficient to decompose organics contained in the refuse but is too low to form PCBs and other hazardous substances, especially in the presence of the limestone and in the absence of air. The reaction products of the limestone and hydrogen chloride, whose reaction is practically completed at the outlet of the mixer 2 and if necessary is completed in the first few feet of the rotary drum, are not decomposed at the temperatures maintained in the rotary drum.

Any salts or metals having a melting point below the temperature in the drum are entrained with the pyrolysis gases and are easily extracted at the distillation column 18.

The pyrolysis gases at a temperature of 570 to 660° F., not contaminated with hazardous substances, are discharged from the kiln 3 at 6*a* and is purified in the dust separator 6. This separator, which may be a cyclone, returns the separated solids to the feed line 1*a* for the mixture of the refuse, limestone and sludge communicating with the bin 1 and hence the rotary kiln 3. The gas phase passes via line 7*a* to a heat exchanger 7 which produces superheated steam from the water vapor supplied via line 7*b* from the washer 5. The superheated steam can be at a temperature of 240 to 250° F. The pyrolysis gases are then condensed in the condenser 8. The noncondensible gas component is fed via line 8*b* to a phase separator 9 and via blower 10 is supplied via line 11*a* to the burner 11 where it mixes with air supplied to line 11*b* by the blower 31. The liquid phase from the phase separator 9 is collected in the separated vessel 15. The burner 11 augments the heat generated in the combustion chamber.

This portion of the pyrolyzed gas can be stripped of $CO_2$ by a solvent extraction, e.g. with a monoethanolamine solution and the $Co_2$ can be recovered and converted to solid or liquid $CO_2$ which is a marketable commodity. The air fed at 11*b* to this burner passes through the slag 14 in a slag cooler 14*a* positioned to receive the slag from the traveling grate 30. Part of that slag can be collected and mixed with the wet solid residue of pyrolysis in a mixer 14*c* as represented by the line 14*e*. By mixing the hot slag with the wet sludge residue of pyrolysis, the latter can be dried to a greater or lesser extent before it is burned on the traveling grate. This method also reduces the amount of water required for the process.

The liquid phase condensed from the pyrolyzed gases is separated into organic and aqueous layers in the separating vessel 15. The organic part can be sued as a liquid fuel for the fire chamber 15 or as a salable commodity, or can be subjected to fractionation for extracting valuable chemicals such as benzene, toluene and the like. For use as a fuel, it is collected in the tank 16 and fed by the pump 17 to a line 17*a* feeding the fuel line 11*b* of the burner 11. Additional fuel can be supplied at 11*c* and excess mixed organic liquid can be discharged at 17*b*.

For fractionation the aqueous phase is fed from the separator 15 via line 15*a* to a feed plate of the distillation column 18.

The same column receives, at a feed plate above the feed plate supplied with the aqueous phase, a mixture of steam and organic vapors discharged from the washing of the solid pyrolysis residue at 5. These gases, collected via line 7*b* and containing water vapor which is heated to superheating temperatures at 7 can be fed to a compressor 19 and passed through the steam ejector 20 before entering via line 20*a* the column 18. The ejector draws off the head gases from the column 21 via line 21*a*.

The distillation column 18 has a stripping section for extraction of water which is withdrawn as a still liquid of this section. This water together with the hot water from condenser 8 (via line 8*a*), from condenser 24 via line 24*a*, from condenser 25 via line 25*a*, from condenser 26 via line 26*a* and from condenser 27 via line 27*a* is recycled to line 5*a* as the scrubbing feeder at 5*b* to the washer 5.

During the quenching in column 18, water soluble salts of metal are dissolved and the water vapor containing organic impurities is fed via the heat exchanger 7 to feed the column 18 through the compressor 19 and ejector 20. Line 5*c* carries the pyrolyzed solids from the rotary kiln 3 to the extent that they are not recycled, to the washer 5 where these solids are intermittently mixed with the wash water supplied at 5*b* by a mixing device 5*d*. The washed solids are then passed through the baffled scrubber 21 in which the solids are contacted by wash water from the sump recycled via the pump 37 to the spray head 21*b* of this scrubber. The gases at the head of this scrubber pass via line 21 as previously described ultimately to the fractionating column 18.

The solids discharged from the scrubber 21 are fed via line 21*c* via mixer 14*c* and to the feeder 30*b* from which these solids are delivered to the traveling grate 30 for incineration in the fire chamber 12 below the rotary kiln 3. Particulates, gases and any liquid and solid fuel are all burned in the chamber 12 with the solids traveling along the chain grate 29 of the traveling grate 30 whose bars support the solids. The solid products are heated, ignited and burned until only a slag or ash is discharged to the cooler 14*a*. Air is passed through the cooler by the blower 13 and is heated and fed via the blower 31, not only to the burner 11 but also via the line 30*c* to the blast boxes 32 below the traveling grate and to nozzles 33 blasting air as secondary air into the chamber 12 to burn off any combustible particles and trained upwardly from the traveling grate. This combustion reduces or eliminates emission of nitrogen oxides and other hazardous gases to the atmosphere. The wet products burned in the chamber 12 and the use of secondary air limits the temperature in the fire chamber to 2010–2200° F., further limiting nitrogen oxide emission.

The portion of the unburned products which fall through the fire bars are recycled via line 30*a* to the mixer 30*b*. The additional fuel at 11*c* is required whenever a large quantity of organic substances are removed from the system as soluble products, and the amount of liquid organics available for fuel is reduced.

The solid slag at 14*b* can be used in structural materials as an aggregate or for road construction.

Via line 3*a*, the flue gas leaves the combustion chamber at a temperature of 1020 to 1200° F. and enters a waste heat boiler 34 which produces steam which is used via line 34*a* for heating the boiler 28 of the column 18 and the boiler 23 of the column 22. Condensate from these boilers and condensate formed elsewhere in the system is collected in the vessel 35 and returned by a pump 36 and line 36*a* to the waste heat boiler 34.

Any liquid losses can be replenished with still liquor from the stripping section of column 18 which likewise can collect in vessel 35. The flue gas from the waste heat boiler 34 is fed via line 34*b* to a unit 38 which extracts inorganic salts from the scrubbing liquid delivered by pump 37. This flue gas is at a temperature of 390 to 480° F. and the inorganic salts are recovered at 38*a* and are of commercial value. The flue gas is then vented through a stack 39. A flue gas entering the stack has a temperature of 175 to 250° F. and can be used in part to parch the solid products of pyrolysis in an additional stage which has not been shown in FIG. 1. The heating utilization in this process has been found to exceed 90%.

Figure 2:
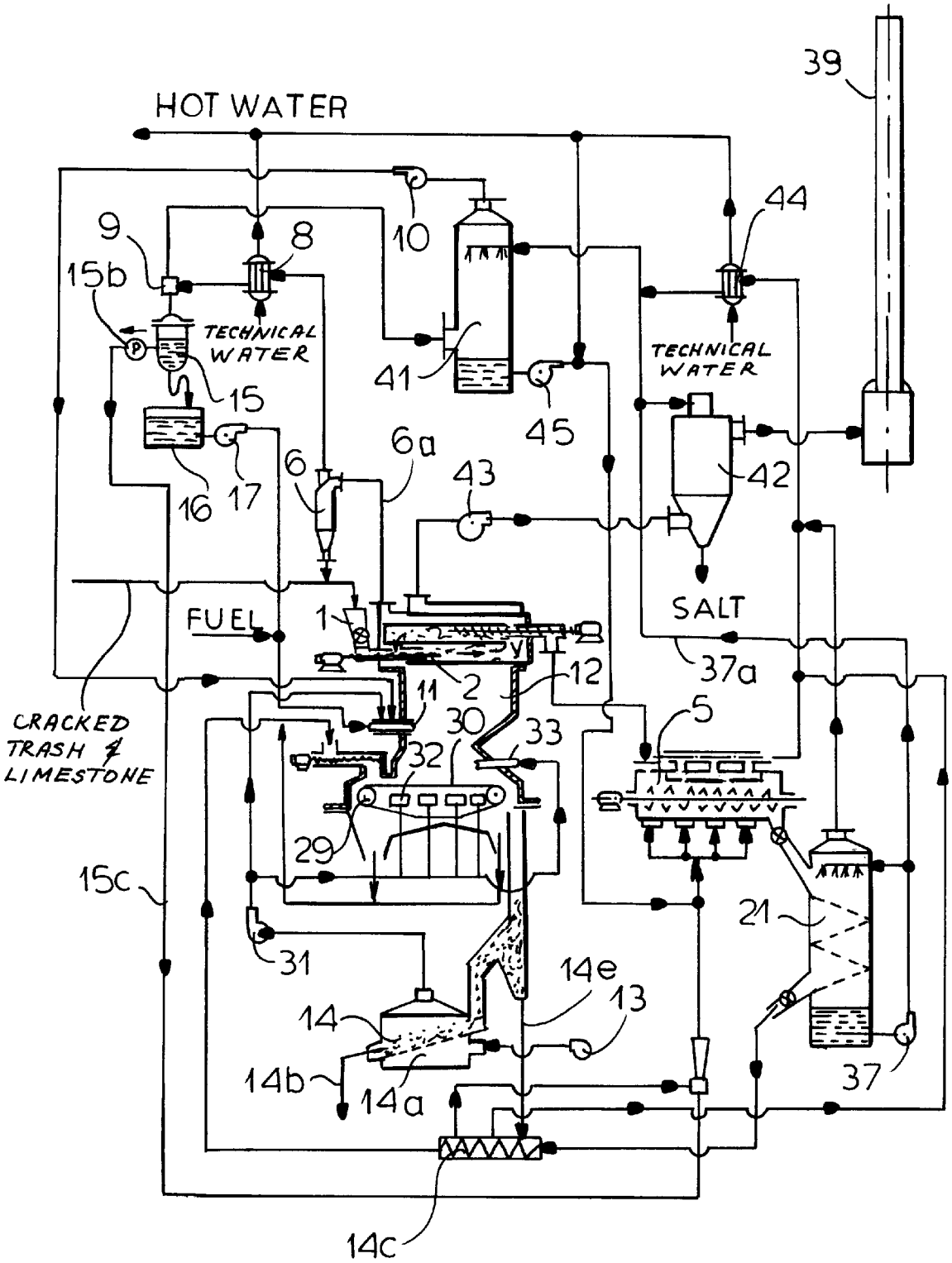
FIG. 2 is a flow diagram of a second embodiment, corresponding reference numerals being used to represent similar functioning elements in the various embodiments.

When the production of liquid organic products as a commodity is not desirable for some reason, the system shown in FIG. 2 can be used, the elements of FIG. 2 bearing numerals corresponding to those of FIG. 1 functioning similarly thereto.

In the system of FIG. 2 the water layer obtained from separating the gaseous products from pyrolysis, after condensation, and collected in the separating vessel 15, is returned directly to the washer 5 via the pump 15*b* and line 15*c*. The pump 37 then can feed the washing liquid via the line 37*a* to a scrubber 41 for the gas phase from the separator 9. Line 37*a* also supplies the washing liquid to a dryer 42 from which a mixture of water soluble salts and heavy metal salts can be formed by evaporation. The pumps 37 and 45 form with the washer 5 and the scrubber 21 a recirculation path for this water. The heating agent is the flue gas from the chamber 12 which is supplied by blower 43 to the dryer 42, the flue gases being ultimately discharged into the atmosphere via the chimney 39. The scrubber scrubs vapor from the washer 5 and the scrubber 21 after condensation in heat exchanger 44. These vapors are mixed with the water fed by a line 37*a* to the scrubber 41.

The direct contact between the washing water and gases in the scrubber 41, by virtue of the difference in partial pressures of the light organics in water and gas results in an enrichment of the organics in the gas phase. It therefore increases the heating value of the gases and reduces the $CO_2$ concentration therein. Fresh water serves as the cooling agent for condensers 8 and 44 and then is used to replenish the circulating system and for hot water heating.

Figure 3:
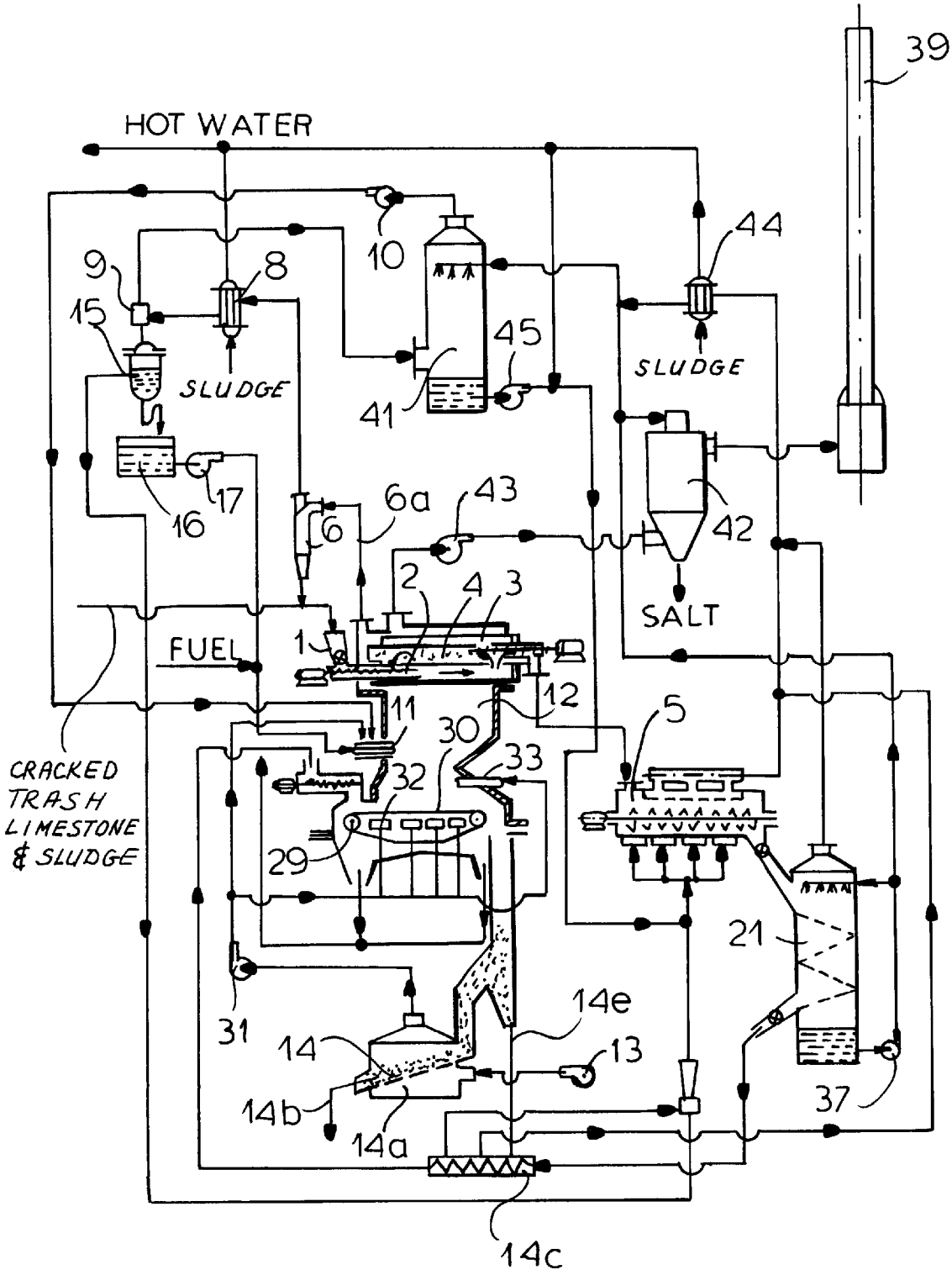
FIG. 3 is a flow diagram of yet another process according to the invention.
Figure 4:
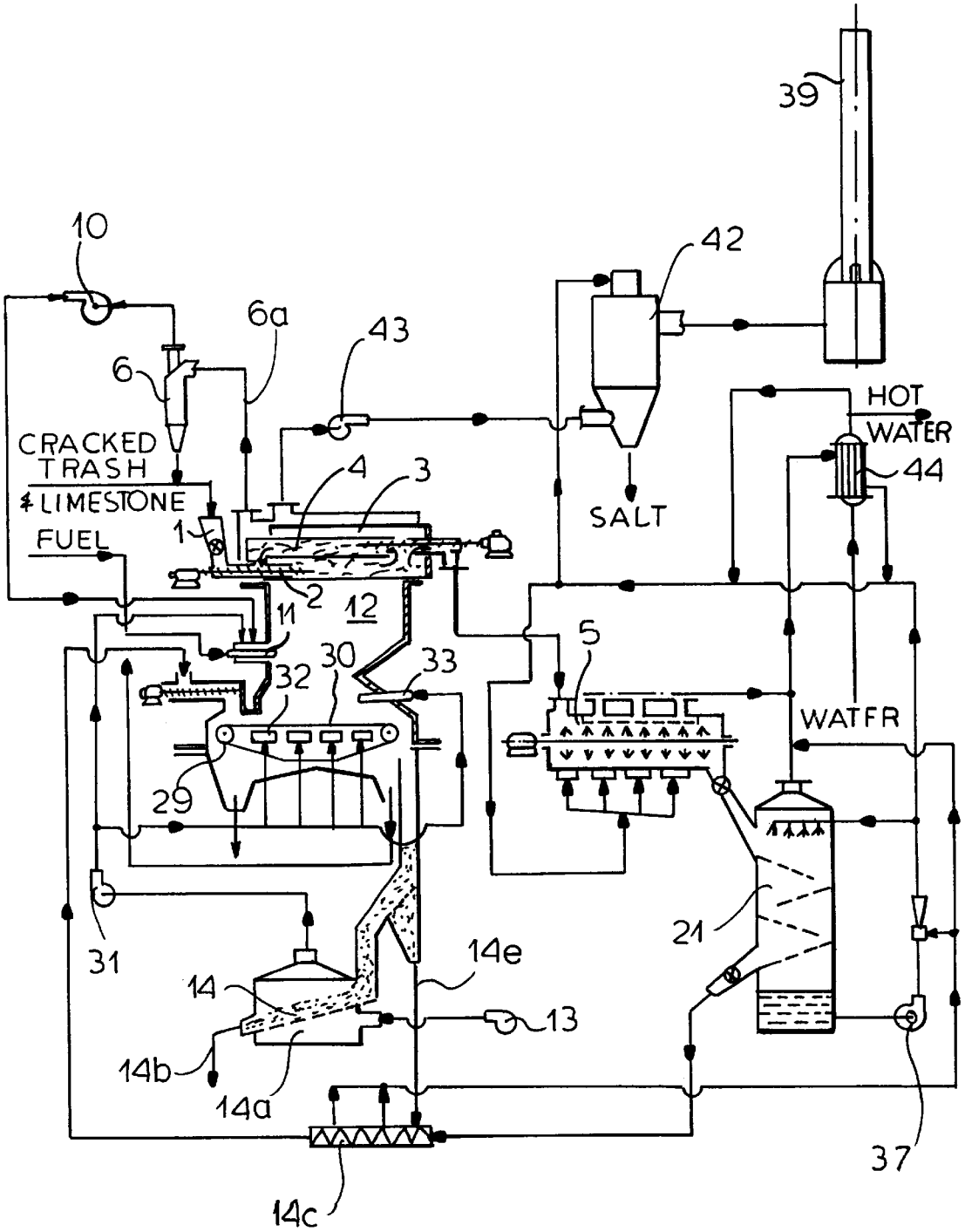
FIG. 4 is a flow diagram of a simpler version.

In the system of FIG. 3, the sewage sludge from a nearby source can be used in place of cooling water in condensers 8 and 44 and, after heating, can be supplied to the bin 1 of the rotary kiln. This system reduces the need for fresh water and is otherwise similar to that of FIG. 2, and in addition eliminates the sludge as a product requiring disposal.

Where availability of water is not a problem and the treated refuse does not contain low melting metals and salts, the simplified system of FIG. 4 can be used. In this case, all of the pyrolysis gas is delivered by blower 10 to the burner 11 of chamber 12 and fresh water of technical grade is used for the condensation of vapor for the washer 5 and the scrubber 21 and is then used for replenishment of the circulation system and for hot water heating.

Figure 5:
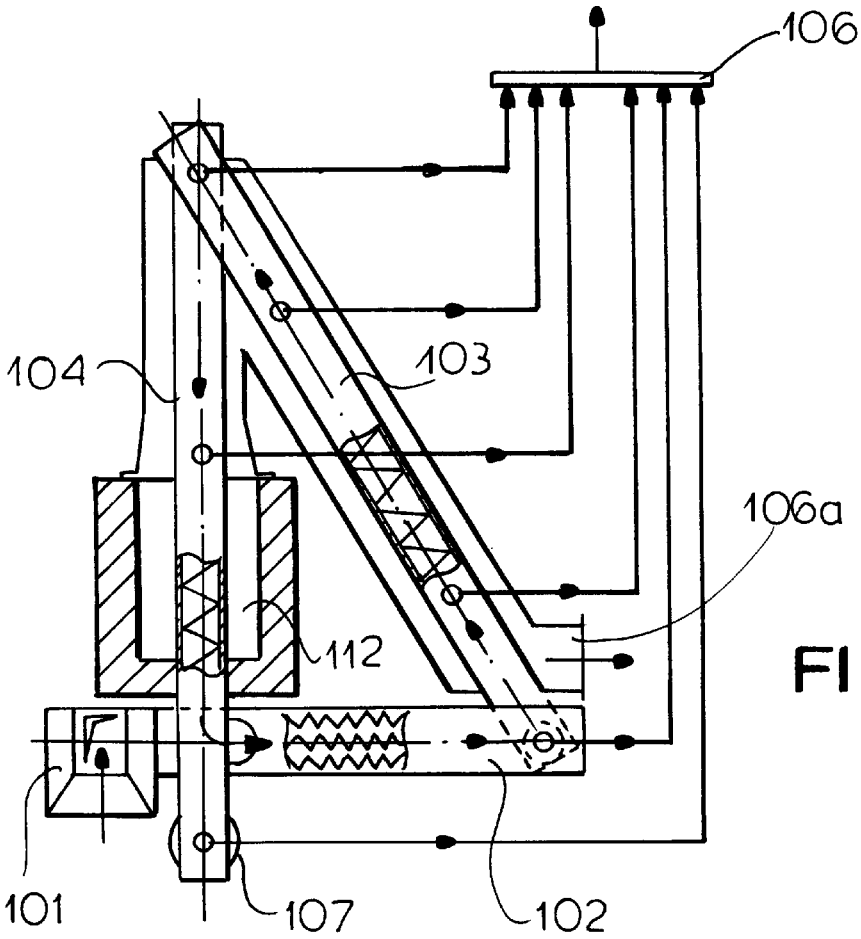
FIG. 5 is a diagram of another pyrolysis unit with a different mode of recycling.
Figure 9:
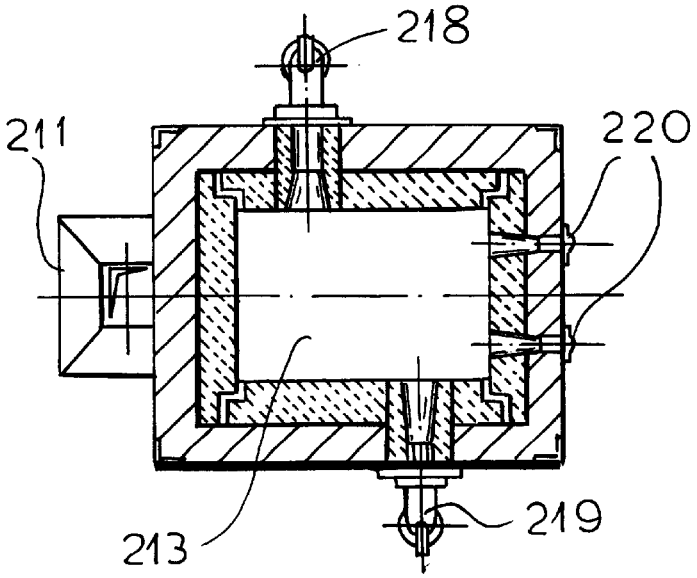
FIG. 9 is a section taken along the line IX—IX of FIG. 8.
Figure 6:
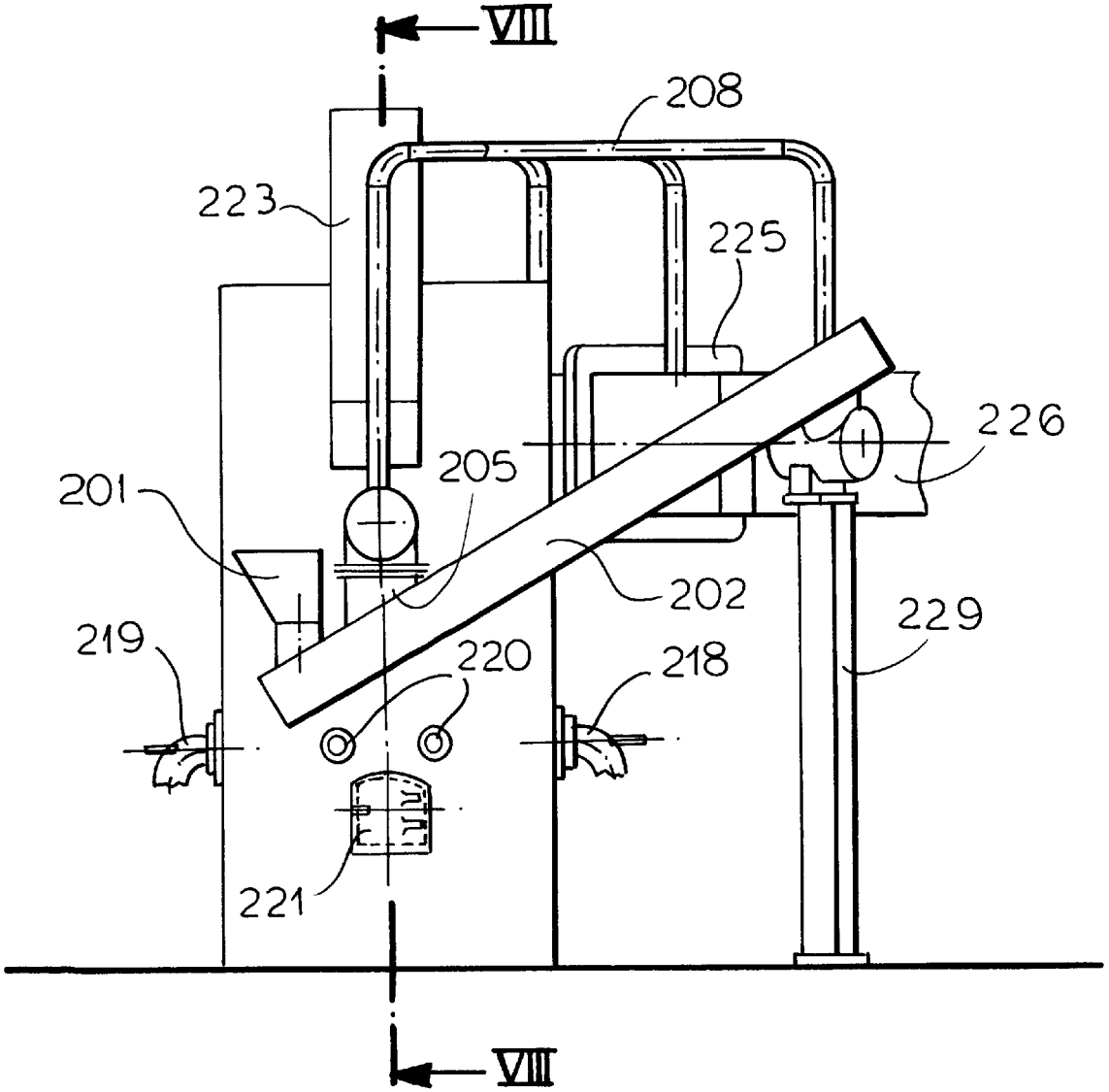
FIG. 6 is a front view of a tube pyrolysis unit of the type shown somewhat schematically in FIG. 5.
Figure 7:
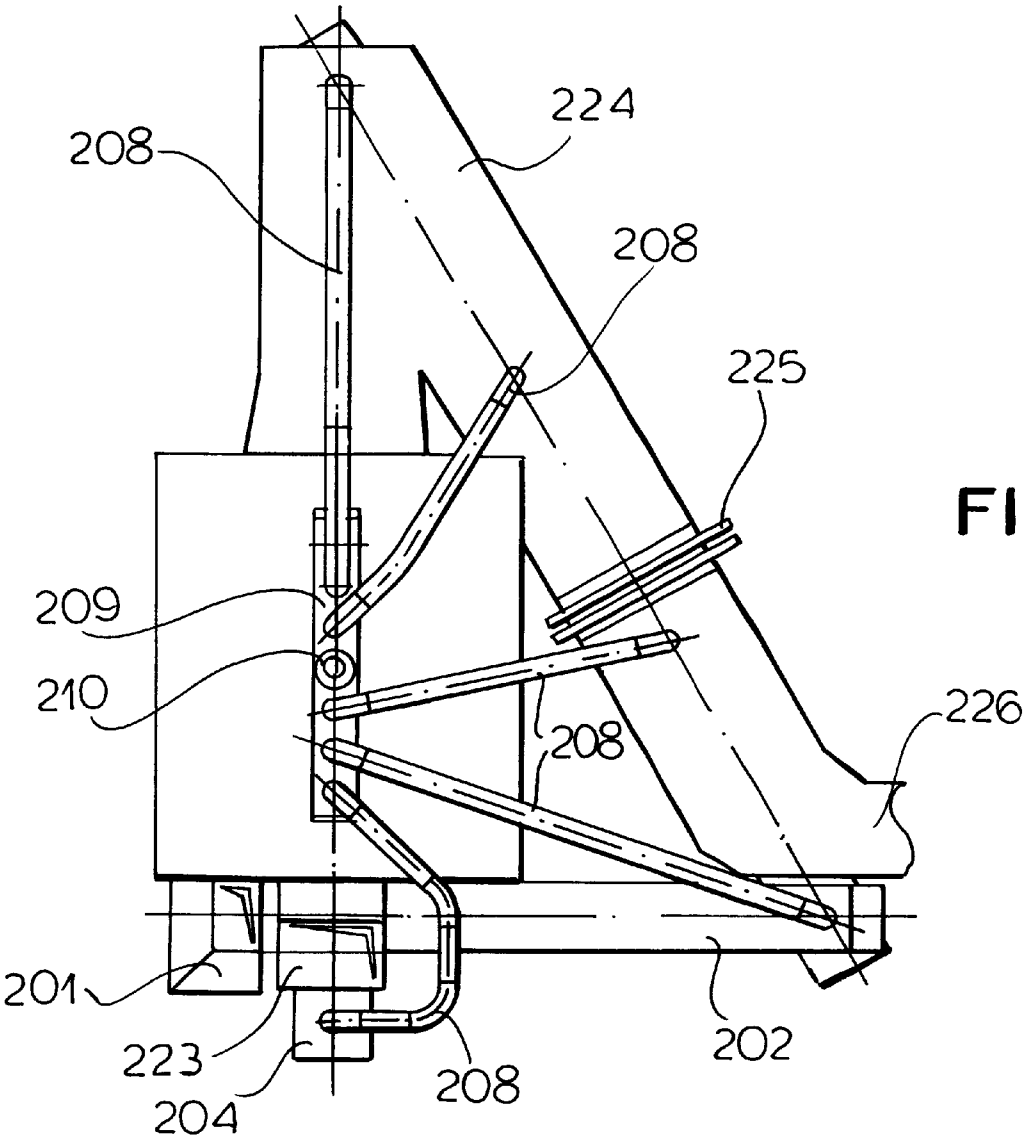
FIG. 7 is a top view of this tube pyrolysis unit.
Figure 8:
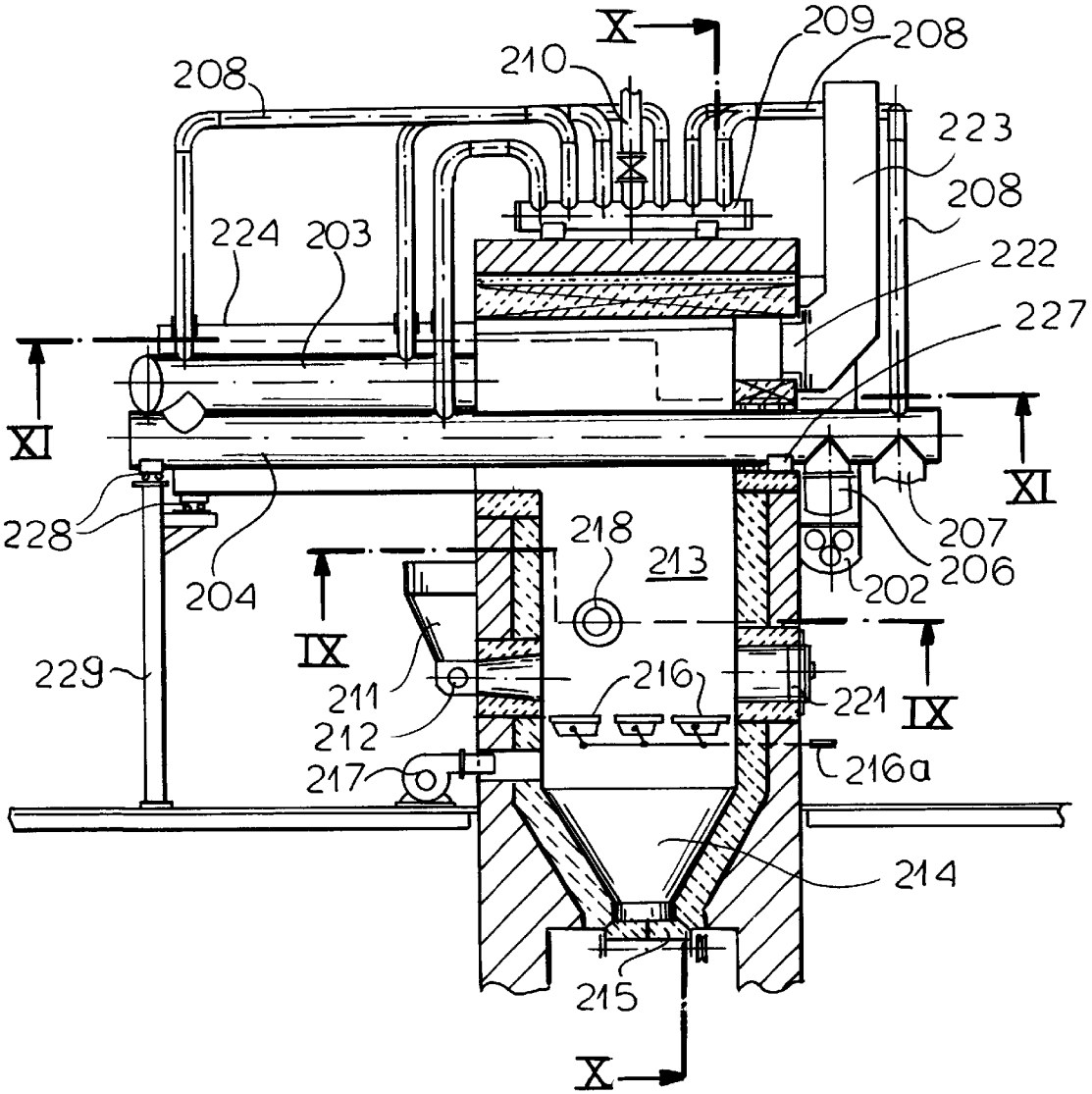
FIG. 8 is a section taken along the line VIII—VIII of FIG. 6.
Figure 10:
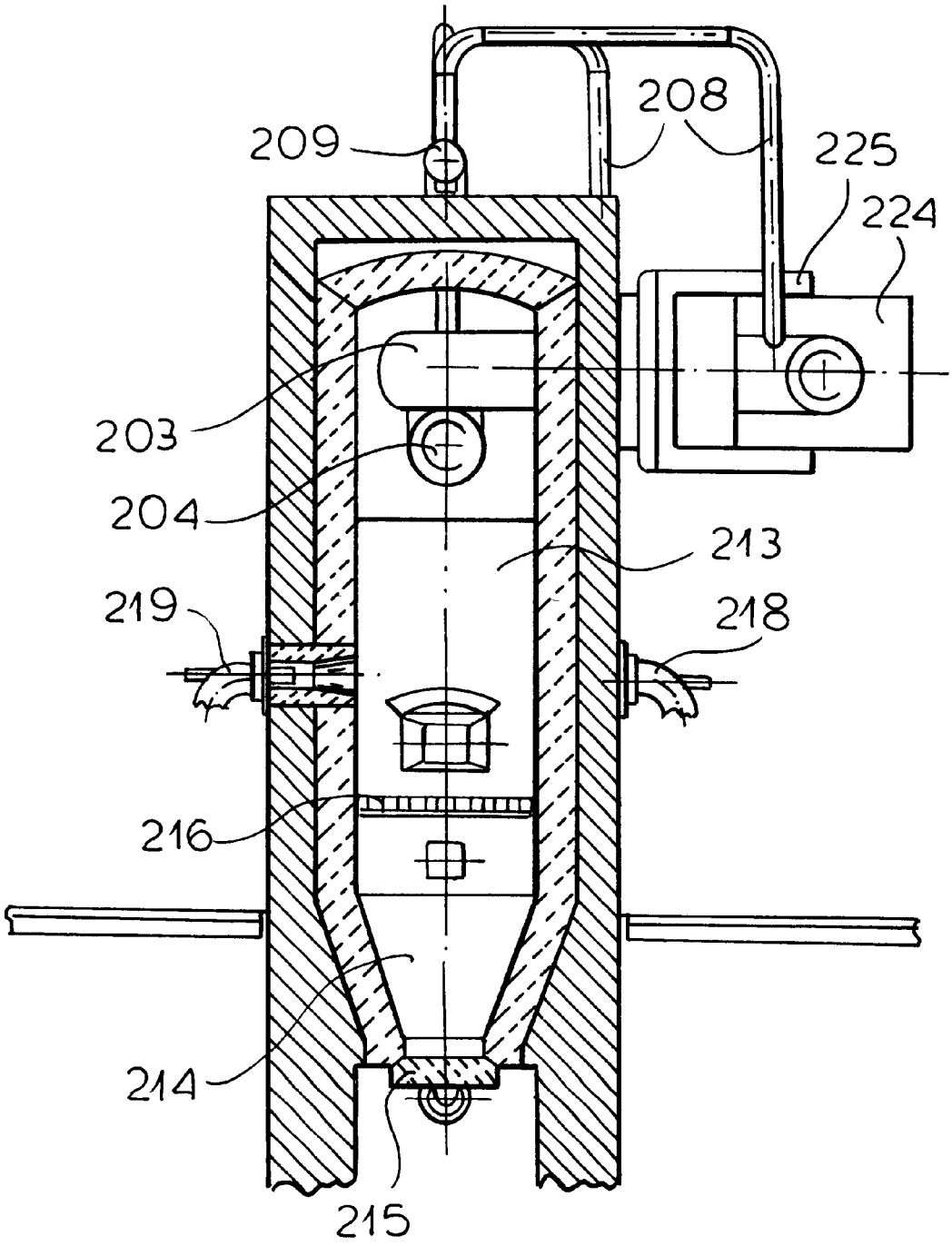
FIG. 10 is a cross sectional view taken along the line X—X of FIG. 8.
Figure 11:
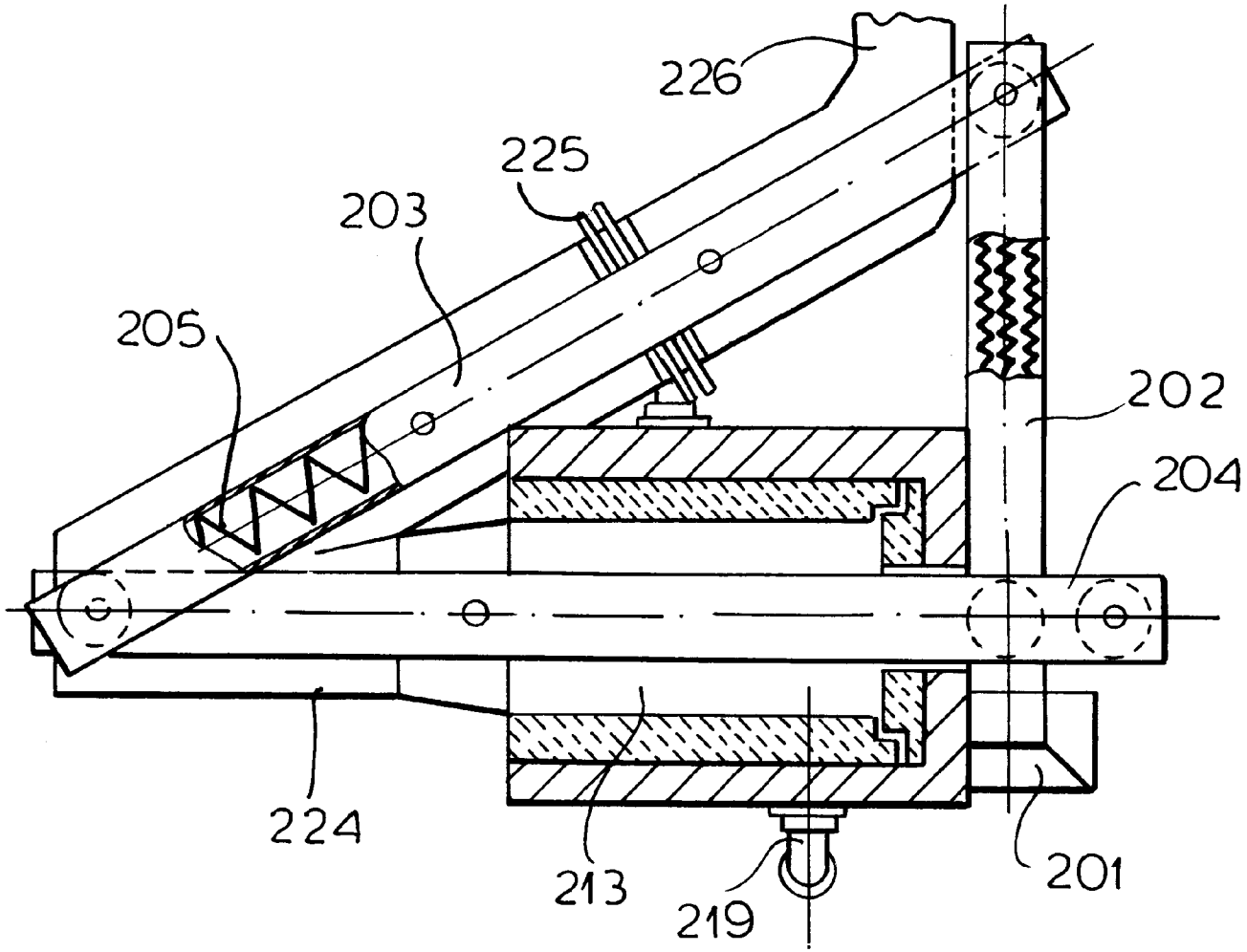
FIG. 11 is a cross sectional view taken along the line XI—XI of FIG. 8.

In each of these systems, especially for low capacity units in place of the rotary drum kiln 3, the pyrolysis unit of FIG. 5 can be used. Here the bin 101 supplies the triple screw mixer 102 with the refuse and limestone mixture. The recycled pyrolysis product is partly fed to the mixer 102 by the screw 104 and is partly discharged to the washer 5 via outlet 107, as shown in FIG. 5 while the mixer 102 feeds the screw 103 which is subjected, like the screw 104 to the flue gas from chamber 12. The flue gas is collected at 106*a* and is directed as has been mentioned above. The pyrolysis gases are collected at 106 and may be fed to the cyclone 6 as has been described above.

FIGS. 6–11 show the details of a tube pyrolysis unit which operates as has been described above in connection with FIG. 5 and can be used in the system of the invention with the function of the tube pyrolysis unit shown in FIG. 5. In FIGS. 6–11, the bin 201 for the mixture of shredded refuse and crushed limestone (FIG. 11) is connected with the mixer 202 which feeds the mixture into a tube kiln having a section 203 and 204. The device for moving the pyrolyzable mixture has been represented at 205 in the form of a screw. The apparatus has the inlet 206 at which the recyclable pyrolyzed product is conducted, the outlet for the solid pyrolyzed product being shown at 207.

Conduits for pyrolysis gas are represented at 208 and communicate with a pyrolysis gas collector 209. At 210 pyrolysis gases are discharged from the tube kiln.

The solid pyrolysis product, after washing, is collected in a bin 211 and injected by a pneumo-mechanical thrower 212 into the combustion chamber 213. The slag collecting part of the furnace is represented at 214 and the slag is discharged through the slag gate 215. The dump grate 216 of the furnace has been shown above the slag collector 214 and has an actuator 216*a* which can dump the residue collected on the grate.

Below the grate, a blower 217 can introduce combustion air into the furnace and a burner for additional fuel has been shown at 218 while a further burner 219 serves to combust gaseous and liquid pyrolysis products.

Viewing ports are provided at 220 allowing the combustion within the chamber to be monitored and manhole 221 is provided for access to the chamber. Valve is provided at 222 for safety purposes and the gas outlet conduit is shown at 223. An expansion joint 225 is provided smoke flue at 224 along the tube kiln to remove stresses resulting from thermal expansion and contraction and the flue gas outlet 226 can be connected to the facilities previously described. The tube kiln has a fixed support 227 and a post 229, supporting the slidable portion in bearings 228.

We claim:

1. A method of treating refuse comprising the steps of:

(a) removing large articles of metals from refuse to form a pyrolyzable refuse product;

(b) mixing said pyrolyzable refuse product with limestone in an amount sufficient to combine with chlorine contained in said pyrolyzable refuse product and optionally with a sewage sludge to form a pyrolyzable mixture;

(c) passing said pyrolyzable mixture through and along a rotary drum of a rotary kiln in one direction while subjecting the pyrolyzable mixture to pyrolysis by heating with a combustion gas to produce pyrolysis gases discharged from said rotary kiln and a pyrolyzed product;

(d) recycling a recycled portion of said pyrolyzed product in a hot state through a recycling tube extending axially through said drum to mix with said pyrolyzable refuse product at an upstream side of said rotary drum whereby said pyrolyzable refuse product is dehydrochlorinated by heat of the recycled portion of pyrolyzed product and simultaneous neutralization of discharged hydrogen chloride by the limestone at a temperature produced at least in part by mixing the recycled portion with said pyrolyzable refuse product;

(e) washing a further portion of said pyrolyzed product with an aqueous washing liquid to remove inorganic salts from said further portion of said pyrolyzed product and produce a washed pyrolyzed product, mixing a hot slag with wet washed products to dry them and use evaporated water from the wet and washed products in the stage of washing; and (f) incinerating said washed pyrolyzed product to produce a slag residue including said hot slag and said combustion gas.

2. The method defined in claim 1 wherein the dehydrochlorination in step (d) is carried out at a temperature of substantially 390° F. to 570° F., the pyrolysis in step (c) is carried out at a temperature of substantially 840° F. to 930° F. and the incineration in step (f) is carried out at a temperature no greater than 2200° F.

3. The method defined in claim 2 wherein some of said pyrolyzed product is washed with aqueous acid and/or water.

4. The method defined in claim 3 wherein the aqueous acid is acetic acid, the acetic acid being obtained during pyrolysis in step (c) and being recovered from said gas mixture by a distillation of liquid recovered from said gas mixture.

5. The method defined in claim 4 wherein the incineration in step (b) is carried out on a traveling grate in a chamber below said rotary column, the combustion gases rising from said traveling grate to said rotary kiln.

6. The method defined in claim 5, further comprising the step of generating at least a portion of said combustion gas at a burner in said chamber and fueling said burner with a combustible distillate from liquid recovered from said gas mixture.

7. An apparatus for treating refuse comprising:

a kiln for pyrolysis of organic compounds which are contained in a pyrolyzable mixture of a pyrolyzable refuse product from which large articles of metals have been removed, limestone in an amount sufficient to combine with chlorine contained in pyrolyzable waste product and optionally a sewage sludge, a device for moving said pyrolyzable mixture and a mixing device, where part of hot solid products of pyrolysis is mixed with said pyrolyzable mixture whereby the pyrolyzable refuse product is dehydrochlorinated and discharged hydrogen chloride is neutralized by limestone at a temperature produced at least in part by mixing a recycled portion of hot solid products with the pyrolyzable refuse product;

said kiln for pyrolysis heated by combustion gas throughout a heat-exchange surface of the kiln;

a fire chamber provided with a traveling grate below said kiln for incinerating washed pyrolyzed product; and a drying mixer for mixing part of said hot slag with the wet washed pyrolyzed product; and a washer between said kiln and said drying mixer for washing further portion of said pyrolyzed product with an aqueous washing liquid to remove inorganic salts from said further portion of said pyrolyzed product and produce said washed pyrolyzed product.

8. The apparatus defined in claim 7, where said kiln for pyrolysis refuse is a rotary kiln having a rotary drum surrounding a recycling tube and fed with a pyrolyzable mixture, said pyrolyzable mixture passing through and along said rotary drum of said rotary kiln in one direction while being subjected to pyrolysis by heating with a combustion gas to produce pyrolysis gases, a portion of a pyrolyzed product produced in said rotary kiln being recycled through said tube in a hot state to mix with said pyrolyzable refuse product at an upstream side of said rotary drum.

9. The apparatus defined in claim 7 wherein said kiln for pyrolysis refuse is a tube kiln, wherein said device for moving said pyrolyzed mixture is a conveyor, said conveyor is mounted in said tube kiln, and where the pyrolyzed product first is moved in a direction away from said mixing device and then in an opposite direction, a portion of the pyrolyzed product being mixed in said mixing device in a hot state with said pyrolyzable refuse product.

10. The apparatus defined in claim 7, further comprising a distillation column having a stripping section connected for separation of a liquid, the liquid obtained from pyrolysis gas is separated into components including at least one fuel component, and means for burning said fuel component in said fire chamber.

11. The apparatus defined in claim 8, further comprising a slag collector for collecting slag discharged from said traveling grate.

12. The apparatus defined in claim 11, further comprising means for blowing air through the collected slag, thereby preheating said air for incineration of said washed pyrolyzed product.

13. A method of treating refuse comprising the steps of:

(a) removing large articles of metals from refuse to form a pyrolyzable refuse product;

(b) mixing said pyrolyzable refuse product with an alkaline substance in an amount sufficient to combine with chlorine contained in said pyrolyzable refuse product and optionally with sewage sludge to form a pyrolyzable mixture;

(c) passing said pyrolyzable mixture along a pyrolysis path in one direction while subjecting the pyrolyzable mixture to pyrolysis by heating with a combustion gas to produce pyrolysis gases discharged from said path and a pyrolyzed product;

(d) recycling a portion of the pyrolyzed product in a hot state to said pyrolyzable refuse product at an upstream side of said path through a mixer whereby said pyrolyzable product is dehydrochlorinated by heat of recycled portion of pyrolyzed product at a temperature produced at least in part by mixing the recycled portion with said pyrolyzable refuse product, and simultaneous neutralization of discharged hydrogen chloride by said alkaline substance;

(e) washing another portion of said pyrolyzed product with an aqueous washing liquid to remove inorganic salts from said other portion of said pyrolyzed product and produce a washed pyrolyzed product, mixing a hot slag and wet washed solids to dry said wet washed solids; and (f) incinerating said washed pyrolyzed product to produce a slag residue including said hot slag and said combustion gas.

* * * * *